US009902916B2

(12) United States Patent
Desantis et al.

(10) Patent No.: US 9,902,916 B2
(45) Date of Patent: Feb. 27, 2018

(54) LUBRICANT COMPOSITION COMPRISING HINDERED CYCLIC AMINES

(71) Applicant: BASF SE, Ludwigshafen (DE)

(72) Inventors: Kevin J. Desantis, Upper Nyack, NY (US); Michael Hoey, Maplewood, NJ (US); Bjoern Ludolph, Ludwigshafen (DE); Matthias Kiefer, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/421,087

(22) PCT Filed: Aug. 14, 2013

(86) PCT No.: PCT/US2013/054959

§ 371 (c)(1),
(2) Date: Feb. 11, 2015

(87) PCT Pub. No.: WO2014/028629

PCT Pub. Date: Feb. 20, 2014

(65) Prior Publication Data

US 2015/0210952 A1 Jul. 30, 2015

Related U.S. Application Data

(60) Provisional application No. 61/682,884, filed on Aug. 14, 2012, provisional application No. 61/682,883, filed on Aug. 14, 2012, provisional application No. 61/682,882, filed on Aug. 14, 2012.

(51) Int. Cl.

| | |
|---|---|
| ***C10M 133/40*** | (2006.01) |
| ***C10M 133/06*** | (2006.01) |
| ***C10M 163/00*** | (2006.01) |

(52) U.S. Cl.

CPC ..... *C10M 133/40* (2013.01); *C10M 133/06* (2013.01); *C10M 163/00* (2013.01); *C10M 2203/1006* (2013.01); *C10M 2203/1025* (2013.01); *C10M 2205/0285* (2013.01); *C10M 2207/026* (2013.01); *C10M 2215/042* (2013.01); *C10M 2215/064* (2013.01); *C10M 2215/08* (2013.01); *C10M 2215/221* (2013.01); *C10M 2215/28* (2013.01); *C10N 2220/021* (2013.01); *C10N 2230/36* (2013.01); *C10N 2240/10* (2013.01); *C10N 2270/02* (2013.01)

(58) Field of Classification Search

CPC C10M 133/06; C10M 133/40; C10M 163/00; C10M 2203/1006; C10M 2203/1025; C10M 2205/0285; C10M 2207/026; C10M 2215/042; C10M 2215/064; C10M 2215/08; C10M 2215/221; C10M 2215/28; C10N 2220/021; C10N 2230/36; C10N 2270/02

USPC ..... 508/262

See application file for complete search history.

(56) References Cited

U.S. PATENT DOCUMENTS

| | | | | |
|---|---|---|---|---|
| 3,398,197 | A | 8/1968 | Miller, Jr. et al. | |
| 4,231,883 | A | 11/1980 | Malec | |
| 4,512,903 | A | 4/1985 | Schlicht et al. | |
| 4,692,256 | A | 9/1987 | Umemura et al. | |
| 4,764,298 | A | 8/1988 | Croudace | |
| 4,795,583 | A | 1/1989 | Papay | |
| 4,857,595 | A | 8/1989 | Kazmierzak et al. | |
| 4,927,562 | A | 5/1990 | Karol et al. | |
| 5,073,278 | A * | 12/1991 | Schumacher | C10M 133/02 508/262 |
| 5,143,634 | A | 9/1992 | Quinga et al. | |
| 5,198,130 | A | 3/1993 | Schumacher | |
| 5,202,038 | A | 4/1993 | Schoch et al. | |
| 5,268,113 | A | 12/1993 | Evans | |
| 5,518,510 | A | 5/1996 | Daly et al. | |
| 5,681,798 | A | 10/1997 | Farng et al. | |
| 5,798,319 | A | 8/1998 | Schlosberg et al. | |
| 6,004,910 | A | 12/1999 | Bloch et al. | |
| 6,649,575 | B2 | 11/2003 | Robson | |
| 6,793,696 | B2 | 9/2004 | Krull et al. | |
| 7,875,579 | B2 | 1/2011 | Chase et al. | |
| 7,932,218 | B2 | 4/2011 | Chasan et al. | |
| 7,939,478 | B2 | 5/2011 | Mayhew et al. | |
| 8,093,190 | B2 | 1/2012 | Chase et al. | |

(Continued)

FOREIGN PATENT DOCUMENTS

| | | |
|---|---|---|
| DE | 2 253 888 A1 | 5/1973 |
| DE | 10 337 901 A1 | 3/2005 |

(Continued)

OTHER PUBLICATIONS

PubChem Database, [2,2,6,6-Tetramethyl-4-(stearoyloxy)piperidinooxyl] radical structure, retrieved from the internet at <https://pubchem.ncbi.nlm.nih.gov/image/fl.html?cid=100958062> on Dec. 5, 2016.*

International Search Report for Application No. PCT/US2013/054929 dated Nov. 13, 2013, 4 pages.

International Search Report for Application No. PCT/US2013/054959 dated Jan. 2, 2014, 4 pages.

International Search Report for Application No. PCT/US2013/054959 dated Aug. 15, 2014, 3 pages.

(Continued)

*Primary Examiner* — James Goloby

(74) *Attorney, Agent, or Firm* — Lowenstein Sandler LLP

(57) ABSTRACT

A lubricant composition includes a base oil and a cyclic amine compound. A method of lubricating a system including a fluoropolymer seal with the lubricant composition is also provided. An additive concentrate for a lubricant composition is also provided. The cyclic amine compound is useful for adjusting the total base number of a lubricant composition. The lubricant composition is compatible with fluoropolymer seals.

20 Claims, No Drawings

(56) References Cited

U.S. PATENT DOCUMENTS

| | | | | |
|---|---|---|---|---|
| 8,143,201 | B2 | 3/2012 | Emert et al. | |
| 2004/0094453 | A1* | 5/2004 | Lok | C10M 101/02 208/19 |
| 2004/0214733 | A1 | 10/2004 | Baba | |
| 2006/0196807 | A1 | 9/2006 | Rosenbaum et al. | |
| 2007/0072096 | A1 | 3/2007 | Takakuwa et al. | |
| 2007/0105729 | A1 | 5/2007 | Hewette et al. | |
| 2008/0051306 | A1 | 2/2008 | Chasan et al. | |
| 2009/0111699 | A1 | 4/2009 | Negishi et al. | |
| 2010/0190898 | A1 | 7/2010 | Negishi et al. | |
| 2011/0077178 | A1 | 3/2011 | Chase et al. | |
| 2011/0077182 | A1 | 3/2011 | Jukes | |
| 2012/0101012 | A1 | 4/2012 | Delbridge et al. | |
| 2012/0202728 | A1 | 8/2012 | Garcia Ojeda | |
| 2012/0258896 | A1* | 10/2012 | Aguilar | C10M 135/18 508/363 |
| 2012/0329690 | A1 | 12/2012 | Truong-Dinh et al. | |
| 2014/0024569 | A1 | 1/2014 | Bera et al. | |

FOREIGN PATENT DOCUMENTS

| | | | |
|---|---|---|---|
| EP | 0 356 677 | A1 | 3/1990 |
| EP | 0 860 495 | A2 | 8/1998 |
| EP | 1 151 994 | A1 | 11/2001 |
| JP | 2003-292982 | A | 10/2003 |
| JP | 2005-146010 | A | 6/2005 |
| JP | 2010-065134 | A | 3/2010 |
| WO | WO 2008/015116 | A2 | 2/2008 |
| WO | WO 2011/042552 | A1 | 4/2011 |
| WO | WO 2011/073960 | A1 | 6/2011 |
| WO | WO 2014/028609 | A1 | 2/2014 |

OTHER PUBLICATIONS

Machine-Assisted English translation for DE 2 253 888 extracted from the espacenet.com database on Feb. 19, 2015, 28 pages.

English language abstract and machine-assisted English translation for DE 10 337 901 extracted from espacenet.com database on Feb. 19, 2015, 21 pages.

English language abstract for EP 0 356 677 extracted from espacenet.com database on Feb. 19, 2015, 1 page.

English language abstract and machine-assisted English translation for JP 2003-292982 extracted from the PAJ database on Feb. 19, 2015, 22 pages.

English language abstract and machine-assisted English translation for JP 2010-065134 extracted from the PAJ database on Feb. 19, 2015, 40 pages.

English language abstract for WO 2011/073960 extracted from espacenet.com database on Feb. 19, 2015, 1 page.

English language abstract and machine-assisted English translation for JP 2005-146010 extracted from espacenet.com database on May 17, 2017, 25 pages.

Partial English language translation of Li et al., Lubricant Additives Chemistry and Applications, 1st Edition, Jul. 31, 2006, pp. 98, 99, 110 provided by CCPIT Patent and Trademark Law Office on Dec. 20, 2016.

* cited by examiner

LUBRICANT COMPOSITION COMPRISING HINDERED CYCLIC AMINES

RELATED APPLICATIONS

This application is the National Stage of International Patent Application No. PCT/US2013/054959, filed on Aug. 14, 2013, which claims priority to and all the advantages of U.S. Patent Application Nos. 61/682,883, 61/682,884 and 61/682,882, filed on Aug. 14, 2012, the content of which are incorporated herein by reference.

FIELD OF THE INVENTION

The present invention generally relates to a lubricant composition. More specifically, the invention relates to a lubricant composition including a cyclic amine compound, to a method of lubricating a system including a fluoropolymer seal with a lubricant composition, and to an additive concentrate for a lubricant composition.

BACKGROUND OF THE INVENTION

It is known and customary to add stabilizers to lubricant compositions based on mineral or synthetic oils in order to improve their performance characteristics. Antioxidants are one type of stabilizer of particular importance because oxidative degradation of lubricant compositions play a significant role in combustion chambers of engines because high and the presence of oxides of nitrogen catalyze oxidation of the lubricant composition.

Some conventional amine compounds are effective stabilizers for lubricants. These conventional amine compounds may help neutralize acids formed during the combustion process. However, these conventional amine compounds are generally not employed in combustion engines due to their detrimental effects on fluoroelastomer seals.

SUMMARY OF THE INVENTION

The present invention provides a lubricant composition comprising a base oil and a cyclic amine compound. The cyclic amine compound has a formula (I):

(I)

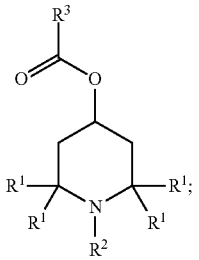

or a formula (II):

(II)

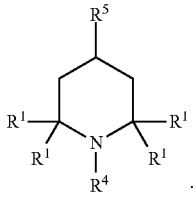

In formulas (I) and (II) above, each $R^1$ is independently selected from hydrogen, and an alkyl group, an alcohol group, an amide group, an ether group, and an ester group, each having from 1 to 17 carbon atoms, with at least one of $R^1$ being an independently selected alkyl group in formula (I) and formula (II). $R^2$ is selected from an alcohol group, an alkyl group, an amide group, an ether group, and an ester group, each having from 1 to 17 carbon atoms. $R^3$ is selected from hydrogen and an alkyl group having from 1 to 17 carbon atoms. $R^4$ is selected from an alcohol group, an amide group, an ether group, an alkyl group and an ester group, each having from 1 to 17 carbon atoms. $R^5$ is selected from hydrogen, an alkyl group having from 1 to 17 carbon atoms, and an ether group having the formula —O—$R^6$, with $R^6$ having from 1 to 17 carbon atoms.

DETAILED DESCRIPTION OF THE INVENTION

One aspect of a lubricant composition is the amount of basic material dispersed/dissolved within it, which is referred to as the Total Base Number ("TBN") of the lubricant composition. TBN is an industry standard measurement used to correlate the basicity of any material to that of potassium hydroxide. This value is measured by two ASTM titration methods, ASTM D2896 and ASTM D4739. Most TBN has been delivered by use of overbased metal soaps, but these soaps created problems with some newer engine technologies, such as diesel particulate filters. Formulations that minimize use of these metal soaps are of value and are referred to as "Low SAPS oils" (SAPS stands for Sulfated Ash, Phosphorus and Sulfur).

The requirements of the Low SAPS designation inherently restrict the amount of traditional calcium and magnesium based detergents found in the lubricant composition. These traditional detergents had many functions, including neutralization of acids formed during the combustion process and generated from the oxidation of a base oil in the lubricant composition. However, the limitation on the amount of these traditional calcium and magnesium based detergents that can be included in a lubricant composition has lowered the capacity of the lubricant composition to neutralize acids. The decreased capacity of the lubricant composition to neutralize acids results in the need to change the lubricant composition more frequently.

The present invention provides a lubricant composition including a base oil and a cyclic amine compound. The present invention also provides a method of lubricating a system with the lubricant composition. The lubricant composition and these methods are described further below.

The present invention describes the stabilization of lubricant compositions with a certain class of amine compounds, the cyclic amine compound described above. Lubricant compositions including the cyclic amine compound help neutralize acids formed during the combustion process. Furthermore, the cyclic amine compound is compatible with fluoroelastomer seals.

The cyclic amine compound has a formula (I):

(I)

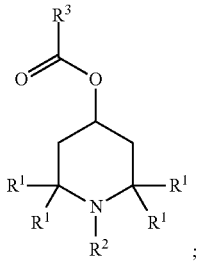

;

or a formula (II):

(II)

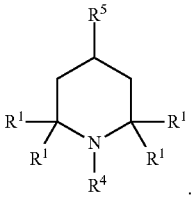

.

In formulas (I) and (II), each $R^1$ is independently selected from hydrogen and an alkyl group, an alcohol group, an amide group, an ether group, and an ester group, each having from 1 to 17 carbon atoms, with at least one $R^1$ being an independently selected alkyl group in each formula (I) and (II). Alternatively, each $R^1$ may be selected independently from hydrogen and an alkyl group, an alcohol group, an amide group, an ether group, and an ester group and have from 1 to 12, 1 to 10, 1 to 8, or 1 to 6 carbon atoms with at least one $R^1$ being an independently selected alkyl group in each formula (I) and (II). In other embodiments, at least two, at least three, or all of the groups, designated by $R^1$, are independently selected alkyl groups in each formula (I) and (II). Each group, designated by $R^1$ may be straight or branched.

In formula (I), $R^2$ is selected from an alcohol group, an alkyl group, an ether group, and an ester group, each having from 1 to 17 carbon atoms. Alternatively, each $R^2$ may be selected from an alcohol group, an alkyl group, an ether group, and an ester group, and may have from 1 to 17 carbon atoms $R^2$ has from 1 to 12, 1 to 10, 1 to 8, or 1 to 4, carbon atoms. Each group designated by $R^2$ may be straight or branched.

In formulas (I) and (II), $R^3$ is selected from hydrogen and an alkyl group having from 1 to 17 carbon atoms. Alternatively, $R^3$ can be an alkyl group having 1 to 10, 1 to 6, or 6 to 14, carbon atoms. Each alkyl group designated by $R^3$ may be straight or branched.

In formula (II), $R^4$ is selected from is selected from an alcohol group, an amide group, an ether group, an alkyl group, and an ester group, each having from 1 to 17 carbon atoms. Alternatively, $R^4$ may independently selected from an alcohol group, an amide group, an ether group, an alkyl group, and an ester group, each having from 1 to 12, 1 to 10, or 1 to 4, carbon atoms. Each group designated by $R^4$ may be straight or branched.

$R^5$ is selected from hydrogen, an alkyl group having from 1 to 17 carbon atoms, and an ether group having the formula —O—$R^6$, with $R^6$ having from 1 to 17 carbon atoms. Alternatively, $R^5$ is a group having from 1 to 12, 1 to 10, 1 to 8, or 6 to 14 carbon atoms. Each group designated by $R^5$ may be straight or branched.

In certain embodiments, at least one group in each formula designated by $R^1$, $R^2$, $R^3$, $R^4$, and $R^5$ is unsubstituted. Alternatively, at least two, three, four, five, or all groups designated by $R^1$, $R^2$, $R^3$, $R^4$, and $R^5$ are unsubstituted in each formula. By "unsubstituted," it is intended that the designated group is free from pendant functional groups, such as hydroxyl, carboxyl, oxide, thio, and thiol groups, and that the designated group is free from acyclic heteroatoms, such as oxygen, sulfur, and nitrogen heteroatoms. In some embodiments, every group designated by $R^1$, $R^2$, $R^3$, $R^4$, and $R^5$ is unsubstituted. Alternatively still, it is contemplated that one, two, three, four, five, or six groups designated by $R^1$, $R^2$, $R^3$, $R^4$, and $R^5$ are substituted. The term "substituted" indicates that the designated group includes at least one pendant functional group, such as hydroxyl, carboxyl, oxide, thio, thiol groups, or that the designated group includes at least one acyclic heteroatom, such as oxygen, sulfur, and nitrogen heteroatoms.

Exemplary $R^1$, $R^2$, $R^3$, $R^4$, $R^5$, and $R^6$ groups may be selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, and n-octadecyl groups.

The cyclic amine compounds of formula (I) may be exemplified by the following compounds:

(1,2,2,6,6-pentamethyl-4-piperidyl)octanoate:

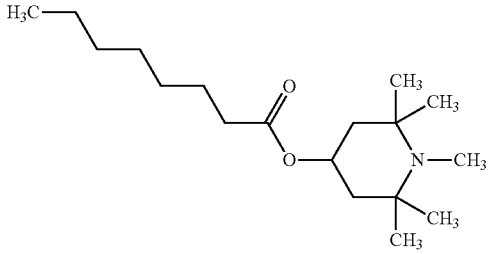

(1,2,2,6,6-pentamethyl-4-piperidyl)decanoate:

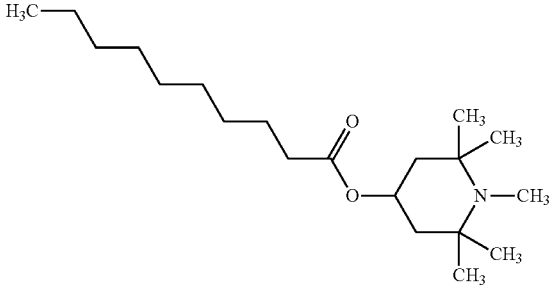

(1,2,2,6,6-pentamethyl-4-piperidyl)dodecanoate:

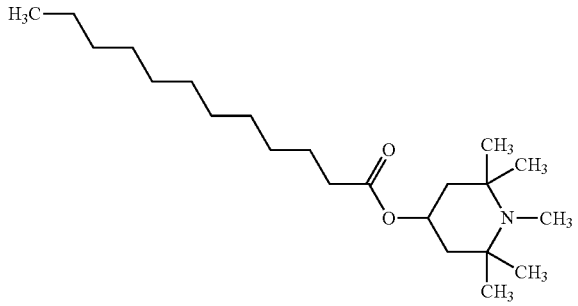

(1,2,2,6,6-pentamethyl-4-piperidyl)tetradecanoate:

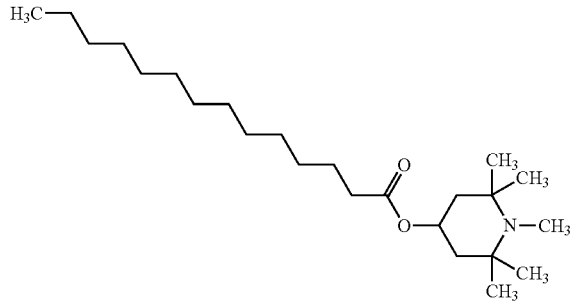

(1,2,2,6,6-pentamethyl-4-piperidyl)hexadecanoate:

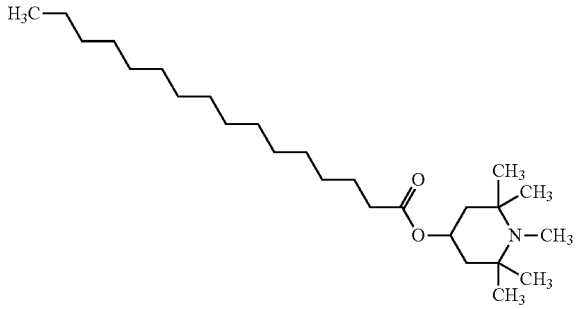

and combinations thereof.

The cyclic amine compounds of formula (II) may be exemplified by the following compounds:

2,2,6,6-tetramethyl-4-octylpiperidine:

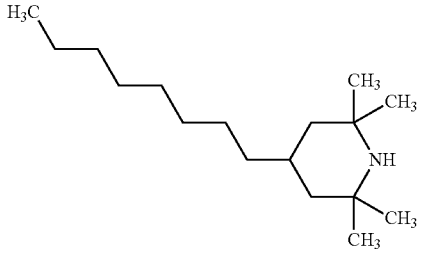

2,2,6,6-tetramethyl-4-decylpiperidine:

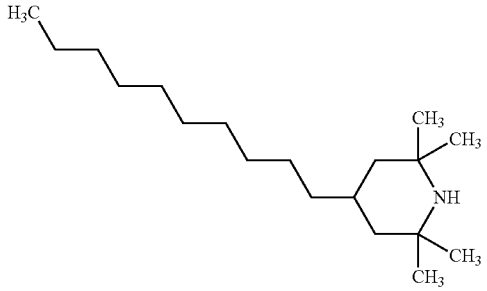

2,2,6,6-tetramethyl-4-butylpiperidine:

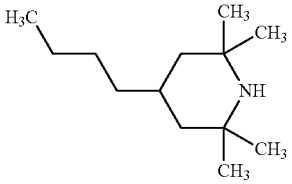

2,2,6,6-tetramethyl-4-hexylpiperidine:

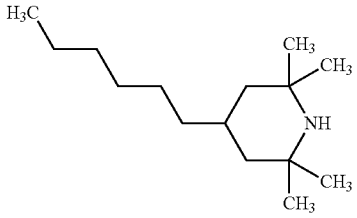

2,2,6,6-tetramethyl-4-hexadecylpiperidine:

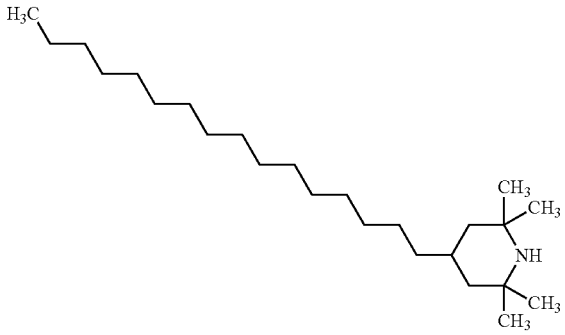

and combinations thereof.

In one or more embodiments, the cyclic amine compound has a weight average molecular weight ranging from 100 to 1200. Alternatively, the cyclic amine compound has a weight average molecular weight ranging from 200 to 800, or from 200 to 600. The weight average molecular weight of the amine compound can be determined by several known techniques, such as gel permeation chromatography.

In one or more embodiments, the cyclic amine compound is non-polymeric. The term "non-polymeric" refers to the fact that the cyclic amine compound includes fewer than 50, 40, 30, 20, or 10 monomer units.

The cyclic amine compound may include a single ester group in certain embodiments, as shown in formula (I). However, in other embodiments, the cyclic amine compound may be free from ester groups. For example, if the cyclic amine compound has the formula (I), the cyclic amine compound includes only one ester group. Furthermore, if the cyclic amine compound has the formula (II), the cyclic amine compound is free from ester groups. The cyclic amine compound of formulas (I) and (II) may comprise a single piperidine ring, with various contemplated substituent groups.

The lubricant composition includes the cyclic amine compound in an amount ranging from 0.1 to 10 wt. % based on the total weight of the lubricant composition. Alternatively, the lubricant composition may comprise the cyclic amine compound in an amount of from 0.5 to 5, or 1 to 3, wt. %, based on the total weight of the lubricant composition. Alternatively, if the lubricant composition is formulated as an additive concentrate, the amine compound may be included in an amount ranging from 0.5 to 90, 1 to 50, 1 to 30, or 5 to 25, wt. %, based on the total weight of the additive concentrate. The cyclic amine compound may be used in combination with various antioxidants, as described below.

As described above, the cyclic amine compound improves the TBN of the lubricant composition. TBN is an industry standard measurement used to correlate the basicity of any material to that of potassium hydroxide. The value is reported as mg KOH/g of the cyclic amine compound and is measured according to ASTM D4739. The TBN of the cyclic amine compound is at least 70, 100, 150, or 180 mg, KOH/g, of the cyclic amine compound when tested according to ASTM D4739.

In one embodiment, the lubricant composition derives at least 5%, at least 10%, at least 20%, at least 40%, at least 60%, at least 80%, or even 100% of the compositional TBN (as measured in accordance with ASTM D4739) from the amine compound. Furthermore, in certain embodiments, the lubricant composition includes an amount of the amine compound that contributes from 0.5 to 15, from 1 to 12, from 0.5 to 4, from 1 to 3, mg KOH/g of TBN (as measured in accordance with ASTM D4739) to the lubricant composition.

The lubricant composition has a TBN value of at least 1 mg KOH/g of lubricant composition. Alternatively, the lubricant composition has a TBN value ranging from 1 to 15, 5 to 15, or 9 to 12, mg KOH/g, of lubricant composition when tested according to ASTM D2896.

The cyclic amine compound is compatible with fluoroelastomer seals. The fluoroelastomer seals may be used in a variety of applications, such as o-rings, fuel seals, valve stem steals, rotating shaft seats, shaft seals, and engine seals. Fluoroelastomer seals may also be used in a variety of industries, such as automotive, aviation, appliance, and chemical processing industries. The fluoroelastomer is categorized under ASTM D1418 and ISO 1629 designation of FKM for example. The fluoroelastomer may comprise copolymers of hexafluoropropylene (HFP) and vinylidene fluoride (VDF of VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies, for example, between 66 to 70 wt. % based on the total weight of the fluoropolymer seal. FKM is fluoro rubber of the polymethylene type having substituent fluoro; perfluoroalkyl, or perfluoroalkoxy groups on the polymer chain.

The compatibility of the fluoroelastomer seals with the cyclic amine compound can be determined with the method defined in CEC-L-39-T96. Generally, conventional amines are very damaging to fluoroelastomers. However, the inventive compositions show positive results with regards to compatibility with fluoroelastomer seals and gaskets.

The CEC-L-39-T96 seal compatibility test is performed by submitting the seal or gaskets in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. The incorporation of the cyclic hindered amine compound into the lubricant composition decreases the tendency of the lubricant composition to degrade the seals, versus other amine compounds.

Previous uses of conventional amine compounds involved forming a reaction product of such conventional amine compounds with various acids, oxides, triazoles, and other reactive components. In these applications, the conventional amine compounds are consumed by certain reactions such that the ultimately formed lubricant composition does not contain significant amounts of the conventional amine compound. In such conventional applications, more than 50 wt. % of the conventional amine compound is typically reacted in the lubricant composition based on the total weight of the amine compound. In contrast, the inventive lubricant compositions and inventive methods contain a significant amount of the cyclic amine compound in an unreacted state. The term "unreacted" refers to the fact that the unreacted portion of the cyclic amine compound does not react with any components in the lubricant composition. Accordingly, the unreacted portion of the cyclic amine compound remains in its virgin state when present in the lubricant composition before the lubricant composition has been used in an end-user application, such as an internal combustion engine.

In certain embodiments, at least 90 wt. % of the cyclic amine compound remains unreacted in the lubricant composition based on a total weight of the cyclic amine compound utilized to form the lubricant composition prior to any reaction in the lubricant composition. Alternatively, at least 95, 96, 97, 98, or 99 wt. % of the cyclic amine compound remains unreacted in the lubricant composition based on the total weight of the cyclic amine compound utilized to form the lubricant composition prior to any reaction in the lubricant composition.

In one or more embodiments, the cyclic amine compound is free of phosphorous. Alternatively, it is also contemplated that the cyclic amine compound consists of nitrogen, hydrogen, and carbon atoms or consists of nitrogen, hydrogen, carbon and oxygen atoms. Furthermore, it is also contemplated that the cyclic amine compound does not form a salt or complex with other components of the lubricant composition.

The phrase "prior to any reaction in the lubricant composition" refers to the basis of the amount of the cyclic amine compound in the lubricant composition. This phrase does not require that the cyclic amine compound react with components present in the lubricant composition, i.e., 100 wt. % may be unreacted in lubricant composition In one embodiment, the percentage of the cyclic amine compound that remains unreacted is determined after all of the components which are present in the lubricant composition reach equilibrium with one another. The time period necessary to reach equilibrium in the lubricant composition may vary widely. For example, the amount of time necessary to reach equilibrium may range from seconds to many days, or even weeks. In certain embodiments, the percentage of the cyclic amine compound that remains unreacted in the lubricant composition is determined after 1 minute, 1 hour, 5 hours, 12 hours, 1 day, 2 days 3 days, 1 week, 1 month, 6 months, or 1 year.

In certain embodiments, the lubricant composition includes less than 0.1, 0.01, 0.001, or 0.0001 wt. % of compounds which would react with the cyclic amine compound based on the total weight of the lubricant composition. In certain embodiments, the lubricant composition may include a collective amount of acids, anhydrides, triazoles, and/or oxides which is less than 0.1 wt. % of the total weight of the lubricant composition. The term "acids" may include both traditional acids and Lewis acids. For example, traditional acids include carboxylic acids, such as glycolic acid, lactic acid, and hydracylic acid; alkylated succinic acids; alkylaromatic sulfonic acids; and fatty acids. Exemplary Lewis acids include alkyl aluminates; alkyl titanates; molybdenumates, such as molybdenum thiocarbamates and molybdenum carbamates; and molybdenum sulfides. "Anhydrides" are exemplified by alkylated succinic anhydrides and acrylates. Triazoles may be represented by benzotriazoles and derivatives thereof; tolutriazole and derivatives thereof; and 2-mercaptobenzothiazole, 2,5-dimercaptothiadiazole, 4,4'-methylene-bis-benzotriazole, 4,5,6,7-tetrahydro-benzotriazole, salicylidenepropylenediamine and salicylamino-guanidine, and salts thereof. Oxides may be represented by alkylene oxides, such as ethylene oxide and propylene oxides; metal oxides; alkoxylated alcohols; alkoxylated amines; and alkoxylated esters. Alternatively, the lubricant composition may include a collective amount of acids, anhydrides, triazoles, and oxides which is less than 0.01, 0.001, or 0.0001 wt. % based on the total weight of the lubricant compositions. Alternatively still, the lubricant composition may be free of acids, anhydrides, triazoles, and oxides.

In yet another embodiment, the lubricant composition may consist, or consist essentially of a base oil and the cyclic amine compound. It is also contemplated that the lubricant composition may consist of, or consists essentially of, the base oil and the cyclic amine compound in addition to one or more of additives that do not compromise the functionality or performance of the cyclic amine compound. In various embodiments where the lubricant composition consists essentially of the base oil and the cyclic amine compound, the lubricant composition is free of, or includes less than 0.01, 0.001, or 0.0001 wt. % of acids, anhydrides, triazoles, and oxides based on the total weight of the lubricant composition. In other embodiments, the terminology "consisting essentially of" describes the lubricant composition being free of compounds that materially affect the overall performance of the lubricant composition as recognized by one of ordinary skill in the art. For example, compounds that materially affect the overall performance of the lubricant composition may be described by compounds which negatively impact the TBN boost, the lubricity, the seal compatibility, the corrosion inhibition, or the acidity of the lubricant composition.

The lubricant composition may include one or more base oils. In certain embodiments, the base oil is selected from an API Group I base oil, API Group II Oil, API Group III Oil, API Group IV Oil, API Group V Oil, and combinations thereof. In one embodiment, the base oil includes an API Group II Oil.

The base oil is classified in accordance with the American Petroleum Institute (API) Base Oil Interchangeability Guidelines. In other words, the base oil may be further described as including one or more of five types of base oils: Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

The base oil typically has a viscosity ranging from 1 to 20 cSt, when tested according to ASTM D445 at 100° C. Alternatively, the viscosity of the base oil may range from 3 to 17, or from 5 to 14 cSt, when tested according to ASTM D445 at 100° C.

The base oil may be further defined as a crankcase lubrication oil for spark-ignited and compression ignited internal combustion engines, including automobile and truck engines, two-cycle engines, aviation piston engines, and marine and railroad diesel engines. Alternatively, the base oil can be further defined as an oil to be used in gas engines, stationary power engines, and turbines. The base oil may be further defined as heavy or light duty engine oil.

In still other embodiments, the base oil may be further defined as synthetic oil which may include one or more alkylene oxide polymers and interpolymers, and derivatives thereof, where their terminal hydroxyl groups are modified by esterification, etherification, or similar reactions. Typically, these synthetic oils are prepared through polymerization of ethylene oxide or propylene oxide to form polyoxyalkylene polymers which can be further reacted to form the oils. For example, alkyl and aryl ethers of these polyoxyalkylene polymers (e.g., methylpolyisopropylene glycol ether having a weight average molecular weight of 1,000; diphenyl ether of polyethylene glycol having a weight average molecular weight of 500-1,000; and diethyl ether of polypropylene glycol having a weight average molecular weight of 1,000-1,500) and/or mono- and polycarboxylic esters thereof (e.g., acetic acid esters, mixed $C_3$-$C_8$ fatty acid esters, or the $C_{13}$ oxo acid diester of tetraethylene glycol) may also be utilized as the base oil.

The lubricant composition can be a low SAPS oil and comprise less than 3, less than 1, or less than 0.5, wt. %, of sulfated ash based on the total weight of the lubricant composition. Furthermore, the lubricant composition can be free from metal salts, or comprise less than 1, less than 0.5, less than 0.1, or less than 0.01, wt. %, metal salts based on the total weight of the lubricant composition.

The base oil is typically present in the lubricant composition in an amount ranging from 70 to 99.9, from 80 to 99.9, from 90 to 99.9, from 75 to 95, from 80 to 90, or from 85 to 95, wt. %, based on the total weight of the lubricant composition. Alternatively, the base oil may be present in the lubricant composition in amounts of greater than 70, 80, 90, 95, or 99, wt. %, based on the total weight of the lubricant composition. In various embodiments, the amount of base oil in the lubricant composition (including diluents or carrier oils which are present) is from 80 to 99.5, from 85 to 96, or from 90 to 95, wt. %, base oil based on the total weight of the lubricant composition.

Alternatively, the base oil may be present in the lubricant composition in an amount ranging from 0.1 to 50, from 1 to 25, or from 1 to 15, wt. %, based on the total weight of the lubricant composition.

The lubricant composition may additionally include one or more additives to improve various chemical and/or physical properties of the lubricant composition. Specific examples of the one or more additives include anti-wear additives, antioxidants, metal deactivators (or passivators), rust inhibitors, viscosity index improvers, pour point depressors, dispersants, detergents, and antifriction additives. Each of the additives may be used alone or in combination. The additive(s) can be used in various amounts, if employed. The lubricant composition may be formulated with the additional of several auxiliary components to achieve certain performance objectives for use in certain applications. For example, the lubricant composition may be a rust and oxidation formulation, a hydraulic formulation, turbine oil, and an internal combustion engine formulation.

If employed, the anti-wear additive can be of various types. In one embodiment, the anti-wear additive is a dihydrocarbyl-dithiophosphate salt, such as a zinc dialkyldithiophosphate. The dihydrocarbyl dithiophosphate salt may be represented by the following general formula: $[R^7O(R^8O)PS(S)]_2M$, wherein $R^7$ and $R^8$ are each independently hydrocarbyl groups having from 1 to 20 carbon atoms, and wherein M is a metal atom or an ammonium group. For example, $R^7$ and $R^8$ are each independently $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The metal atom is selected from the group including aluminum, lead, tin, manganese, cobalt, nickel, or zinc. The ammonium group may be derived from ammonia or a primary, secondary, or tertiary amine. The ammonium group may be of the formula $R^9R^{10}R^{11}R^{12}N^+$, wherein $R^9$, $R^{10}$, $R^{11}$, and $R^{12}$ each independently designates a hydrogen atom or a hydrocarbyl group having from 1 to 150 carbon atoms. In certain embodiments, $R^9$, $R^{10}$, $R^{11}$, and $R^{12}$ may each independently designate hydrocarbyl groups having from 4 to 30 carbon atoms.

Alternatively, the anti-wear additive may include sulfur, phosphorus, and/or halogen containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl)phosphorothioate and mixtures thereof (for example tris(isononylphenyl)phosphorothioate), diphenyl mononon-ylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris [isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

If employed, the anti-wear additive can be used in various amounts. The anti-wear additive is typically present in the lubricant composition in an amount ranging from 0.1 to 20, 0.5 to 15, 1 to 10, 0.1 to 1, 0.1 to 0.5, or 0.1 to 1.5, wt. %, based on the total weight of the lubricant composition. Alternatively, the anti-wear additive may be present in amounts of less than 20, less than 10, less than 5, less than 1, or less than 0.1, wt. %, based on the total weight of the lubricant composition. The anti-wear additive may be present in the additive concentrate in an amount ranging from 0.1 to 99, from 1 to 70, from 5 to 50, or from 25 to 50, wt. %, each based on the total weight of the additive concentrate.

If employed, the antioxidant can be of various types. These antioxidants may be included in addition to the cyclic amine compound of formulas (I) and (II) described above. Suitable antioxidants include alkylated monophenols, for example, 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example, 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate, and combinations thereof, may also be utilized.

Furthermore, hydroxylated thiodiphenyl ethers, for example, 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example, 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis (4,6-di-tert-butylphenol), 2,2'-ethylidenebis(6-tert-butyl-4-isobutylphenol), 2,2'-methylenebis [6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis (5-tert-butyl-4-hydroxy-2-methyl-phenyl)-3-n-dodecylmercapto butane, ethylene glycol bis[3,3-bis(3'-tert-butyl-4'-hydroxyphenyl)butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example, 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example, dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis [4-(1,1,3,3-tetramethyl-butyl)phenyl]-2,2-bis(3,5-di-tert-butyl-4-hydroxybenzyl) malonate, and combinations thereof are also suitable for use as antioxidants.

Triazine compounds, for example, 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris (3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethyl-benzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl 3,5-di-tert-butyl-4-hydroxybenzyl-phosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example, 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g., with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl) isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used.

Additional examples of suitable antioxidants include those that include nitrogen, such as amides of β-(3,5-di-tert-butyl-4-hydroxyphenyl)propionic acid e.g., N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis (1,4-dimethyl-pentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenyl amine, N,N'-dimethyl-N,N'-di-sec-butyl-p-phenylenediamine, diphenyl amine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethylpiperid-4-yl)sebacate, 2,2,6,6-tetramethylpiperidin-4-one and 2,2,6,6-tetramethylpiperidin-4-ol, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant is typically present in the lubricant composition in an amount ranging from 0.01 to 5, 0.1 to 3, or 0.5 to 2 wt. % based on the weight of the lubricant composition, not including the cyclic amine compound of formulas (I) and (II). Alternatively, the antioxidant may be present in amounts of less than 5, less than 3, or less than 2 wt. % based on the total weight of the lubricant composition, not including the cyclic amine compound of formulas (I) and (II). The antioxidant may be present in the additive concentrate in an amount ranging from 0.1 to 99, from 1 to 70, from 5 to 50, or from 25 to 50, wt. %, based on the total weight of the additive concentrate, not including the cyclic amine compound of formulas (I) and (II).

If employed, the metal deactivator can be of various types. Suitable metal deactivators include benzotriazoles and derivatives thereof, for example 4- or 5-alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl)tolutriazole, and combinations thereof.

Additional examples of suitable metal deactivators include 1,2,4-triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator is typically present in the lubricant composition in an amount ranging from 0.01 to 0.1, 0.05 to 0.01, or 0.07 to 0.1, wt. % based on the total weight of the lubricant composition. Alternatively, the metal deactivator may be present in amounts of less than 0.1, less than 0.7, or less than 0.5, wt. % based on the total weight of the lubricant composition. The metal deactivator may be present in the additive concentrate in an amount ranging from 0.1 to 99, from 1 to 70, from 5 to 50, or from 25 to 50, wt. %, based on the total weight of the additive concentrate.

If employed, the rust inhibitor and/or friction modifier can be of various types. Suitable examples of rust inhibitors and/or friction modifiers include organic acids, their esters, metal salts, amine salts and anhydrides, for example, alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof, and combinations thereof. Additional examples include nitrogen-containing compounds, for example, primary, secondary or tertiary aliphatic or cycloaliphatic amines and amine salts of organic and inorganic acids, for example, oil-soluble alkylammonium carboxylates, and also 1-[N,N-bis(2-hydroxyethyl)amino]-3-(4-nonylphenoxy) propan-2-ol, and combinations thereof. Further examples include heterocyclic compounds, for example: substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, and zinc dialkyldithiophosphates, molybdenum-containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols, and combinations thereof.

If employed, the rust inhibitor and/or friction modifier can be used in various amounts. The rust inhibitor and/or friction modifier is typically present in the lubricant composition in an amount ranging from 0.01 to 0.1, 0.05 to 0.01, or 0.07 to 0.1 wt. % based on the total weight of the lubricant composition. Alternatively, the rust inhibitor and/or friction modifier may be present in amounts of less than 0.1, less than 0.7, or less than 0.5 wt. % based on the total weight of the lubricant composition. The rust inhibitor and/or friction modifier may be present in the additive concentrate in an amount ranging from 0.01 to 0.1, from 0.05 to 0.01, or from 0.07 to 0.1, wt. %, based on the total weight of the additive concentrate.

If employed, the viscosity index improver (VII) can be of various types. Suitable examples of VIIs include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the VII can be used in various amounts. The VII is typically present in the lubricant composition in an amount ranging from 0.01 to 20, 1 to 15, or 1 to 10 wt. % based on the total weight of the lubricant composition. Alternatively, the VII may be present in amounts of less than 10, less than 8, or less than 5 wt. %, based on the total weight of the lubricant composition. The VII may be present in the additive concentrate in an amount ranging from 0.01 to 20, from 1 to 15, or from 1 to 10, wt. %, based on the total weight of the additive concentrate.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant is typically present in the lubricant composition in an amount ranging from 0.01 to 0.1, 0.05 to 0.01, or 0.07 to 0.1, wt. %, based on the total weight of the lubricant composition. Alternatively, the pour point depressant may be present in amounts of less than 0.1, less than 0.7, or less than 0.5, wt. %, based on the total weight of the lubricant composition. The pour point depressant may be present in the additive concentrate in an amount ranging from 0.1 to 99, from 1 to 70, from 5 to 50, or from 25 to 50, wt. %, based on the total weight of the additive concentrate.

If employed, the dispersant can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

The amine dispersant may be a polyalkene amine. The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methylbutene, 1-hexene, 2-methylpentene, 3-methylpentene, and 4-methylpentene. The polyalkene moiety has a number average molecular weight Mn ranging from 200 to 10,000.

In one configuration, the polyalkene amine is derived from a polyisobutene. Particularly suitable polysiobutenes are known as "highly reactive" polyisobutenes which feature a high content of terminal double bonds. Suitable highly reactive polyisobutenes are, for example, polyisobutenes which have a fraction of terminal vinylidene double bonds of greater than 70 mol %, greater than 80 mol %, greater than 85 mol %, greater than 90 mol %, or greater than 92 mol %, based on the total number of double bonds in the polyisobutene. Further preference is given in particular to polyisobutenes which have uniform polymer frameworks. Uniform polymer frameworks are those polyisobutenes which are composed of at least 85, 90, or 95, wt. %, of isobutene units. Such highly reactive polyisobutenes preferably have a number-average molecular weight in the abovementioned range. In addition, the highly reactive polyisobutenes may have a polydispersity ranging from 1.05 to 7, or from 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The polyalkene amine may comprise moieties derived from succinic anhydride and may comprise hydroxyl and/or amino and/or amido and/or imido groups. For example, the amine dispersant may be derived from polyisobutenylsuccinic anhydride which is obtainable by reacting conventional or highly reactive polyisobutene having a number average molecular weight ranging from 300 to 5000 with maleic anhydride by a thermal route or via chlorinated polyisobutene. Particular interest attaches to derivatives with aliphatic polyamines such as ethylenediamine, diethylenetriamine, triethylenetetramine or tetraethylenepentamine.

To prepare the polyalkene amine, the polyalkene component may be aminated in a manner known per se. A preferred process proceeds via the preparation of an oxo intermediate by hydroformylation and subsequent reductive amination in the presence of a suitable nitrogen compound.

The amine dispersant may be represented by the general formula: $HNR^{13}R^{14}$, where $R^{13}$ and $R^{14}$ may each independently be a hydrogen atom or a hydrocarbyl group having from 1 to 17 carbon atoms, or analogs thereof which have been mono- or polyhydroxylated. The amine dispersant may also be a poly(oxyalkyl) radical or a polyalkylene polyamine radical of the general formula Z—NH—($C_1$-$C_6$-alkylene-NH)$_m$—$C_1$-$C_6$-alkylene, where m is an integer ranging from 0 to 5, Z is a hydrogen atom or a hydrocarbyl group having from 1 to 6 carbon atoms with $C_1$-$C_6$ alkylene representing the corresponding bridged analogs of the alkyl radicals. The amine dispersant may also be a polyalkylene imine radical composed of from 1 to 10 $C_1$-$C_4$ alkylene imine groups; or, together with the nitrogen atom to which they are bonded, are an optionally substituted 5- to 7-membered heterocyclic ring which is optionally substituted by from one to three $C_1$-$C_4$ alkyl radicals and optionally bears one further ring heteroatom, such as O or N.

Examples of suitable alkyl radicals include straight-chain or branched radicals having from 1 to 18 carbon atoms, such as methyl, ethyl, iso- or n-propyl, n-, iso-, sec- or tert-butyl, n- or isopentyl; and also n-hexyl, n-heptyl, n-octyl, n-nonyl, n-decyl, n-undecyl, n-tridecyl, n-tetradecyl, n-pentadecyl, n-hexadecyl and n-octadecyl, and also the mono- or polybranched analogs thereof; and also corresponding radicals in which the hydrocarbon chain has one or more ether bridges.

Examples of suitable alkenyl radicals include mono- or polyunsaturated, preferably mono- or di-unsaturated analogs of alkyl radicals has from 2 to 18 carbon atoms, in which the double bonds may be in any position in the hydrocarbon chain.

Examples of $C_4$-$C_{18}$ cycloalkyl radical include cyclobutyl, cyclopentyl and cyclohexyl, and also the analogs thereof substituted by from 1 to 3 $C_1$-$C_4$ alkyl radicals: The $C_1$-$C_4$ alkyl radicals are, for example, selected from methyl, ethyl, iso- or n-propyl, n-, iso-, sec- or tert-butyl.

Examples of the arylalkyl radical include a $C_1$-$C_{18}$ alkyl group and an aryl group which are derived from a monocyclic or bicyclic, 4- to 7-membered, in particular, 6 membered aromatic or heteroaromatic group, such as phenyl, pyridyl, naphthyl and biphenyl.

Examples of suitable compounds of the general formula $HNR^{13}R^{14}$ are: ammonia; primary amines such as methylamine, ethylamine, n-propylamine, isopropylamine, n-butylamine, isobutylamine, sec-butylamine, tert-butylamine, pentylamine, hexylamine, cyclopentylamine and cyclohexylamine; primary amines of the formulas: $CH_3$—O—$C_2H_4$—$NH_2$, $C_2H_5$—O—$C_2H_4$—$NH_2$, $CH_3$—O—$C_3H_6$—$NH_2$, $C_2H_5$—O—$C_3H_6$—$NH_2$, $C_4H_9$—O—$C_4H_8$—$NH_2$, HO—$C_2H_4$—$NH_2$, HO—$C_3H_6$—$NH_2$ and HO—$C_4H_8$—$NH_2$; secondary amines, for example dimethylamine, diethylamine, methylethyl amine, di-n-propyl amine, diisopropylamine, diisobutylamine, di-sec-butylamine, di-tert-butylamine, dipentylamine, dihexylamine, dicyclopentylamine, dicyclohexylamine and diphenylamine; and also secondary amines of the formulas: ($CH_3$—O—$C_2H_4$)$_2$NH, ($C_2H_5$—O—$C_2H_4$)$_2$NH, ($CH_3$—O—$C_3H_6$)$_2$NH, ($C_2H_5$—O—$C_3H_6$)$_2$NH, (n-$C_4H_9$—O—$C_4H_8$)$_2$NH, (HO—$C_2H_4$)$_2$NH, (HO—$C_3H_6$)$_2$NH and (HO—$C_4H_8$)$_2$NH; and heterocyclic amines, such as pyrrolidine, piperidine, morpholine and piperazine, and also their substituted derivatives, such as N—$C_{1-6}$ alkylpiperazines and dimethylmorpholine; and polyamines and polyimines, such as n-propylenediamine, 1,4-butanediamine, 1,6-hexanediamine, diethylenetriamine, triethylenetetramine and polyethylene imines, and also their alkylation products, for example 3-(dimethylamino)-n-propylamine, N,N-dimethylethylenediamine, N,N-diethylethylenediamine and N,N,N',N'-tetramethyldiethylenetriamine.

If employed, the dispersant can be used in various amounts. The dispersant is typically present in the lubricant composition in an amount ranging from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, based on the total weight of the lubricant composition. These dispersants may be present in the additive concentrate in an amount ranging from 0.1 to 99, from 1 to 70, from 5 to 50, or from 25 to 50, wt. %, based on the total weight of the additive concentrate.

If employed, the detergent can be of various types. Suitable examples of detergents include overbased or neutral metal sulphonates, phenates and salicylates, and combinations thereof.

If employed, the detergent can be used in various amounts. The detergent is typically present in the lubricant composition in an amount ranging from 0.01 to 5, 0.1 to 4, 0.5 to 3, or 1 to 3 wt. %, based on the total weight of the lubricant composition. Alternatively, the detergent may be present in amounts of less than 5, less than 4, less than 3, less than 2, or less than 1 wt. %, based on the total weight of the lubricant composition. The detergent is typically present in the additive concentrate in an amount ranging from 0.1 to 99, from 1 to 70, from 5 to 50, or from 25 to 50, wt. %, based on the total weight of the additive concentrate.

In various embodiments, the lubricant composition is substantially free of water, e.g., the lubricant composition includes less than 5, less than 1, less than 0.5, or less than 0.1, wt. %, of water based on the total weight of the lubricant composition. Alternatively, the lubricant composition may be completely free of water.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of lubricating a system including a fluoropolymer seal is also provided. The method includes contacting the fluoropolymer seal with the cyclic amine compound described above. The acyclic amine compound may be dissolved in the base oil, and as such, the method may also include contacting the fluoropolymer seal with the lubricant composition. The system including the fluoropolymer seal may comprise an internal combustion engine. Alternatively, the system including the fluoropolymer seal may comprise a diesel engine, a transmission, a gearing, a conveyor, or other device utilizing liquid lubricants.

Further, a method of forming the lubricant composition is provided. The method includes combining the base oil and the cyclic amine compound. The cyclic amine compound may be incorporated into the base oil in any convenient way. Thus, the cyclic amine compound can be added directly to the base oil by dispersing or dissolving it in the base oil at the desired level of concentration. Alternatively, the base oil may be added directly to the cyclic amine compound in conjunction with agitation until the cyclic amine compound is provided at the desired level of concentration. Such blending may occur at ambient or elevated temperatures. In one embodiment, one or more of the additives are blended into a concentrate that is subsequently blended into the base oil to make the lubricant composition. The concentrate will typically be formulated to provide the desired concentration in the lubricant composition when the concentrate is combined with a predetermined amount of base oil.

EXAMPLES

A fully formulated lubricating oil composition containing dispersant, detergent, aminic antioxidant, phenolic antioxidant, anti-foam, base oil, antiwear additive, pour point depressant and viscosity modifier was prepared. This lubricant composition, which is representative of a commercial crankcase lubricant, is designated as the "reference lubricant" and used as a baseline to compare the effects of different amine compounds on seal compatibility.

The reference lubricant was combined with various different aminic compounds to determine the effect of the aminic compounds on seal compatibility. Inventive Examples #1 and #2 include an amine compound contemplated according to two embodiments of the present invention. Comparative Examples #1-3 include other aminic compounds falling outside the scope of the present invention.

The compound added to the reference lubricant in Inventive Example #1 is Tinuvin 292 (a blend of Bis-(1,2,2,6,6-pentamethyl-4-piperidinyl)-sebacate and methyl-(1,2,2,6,6-pentamethyl-4-piperidinyl)-sebacate). The compound added to the reference lubricant in Inventive Example #2 is 1,2,2,6,6-pentamethylpiperidyl-4-dodecanoate. The compound added to the reference lubricant in Comparative Example #1 is 1-dodecylamine; the compound added to the reference lubricant in Comparative Example #2 is N—N-dimethylcyclohexylamine; and the compound added to the reference lubricant in Comparative Example #3 is 4-benzylpiperidine.

Each aminic additive was added in an amount sufficient to provide 3 units of TBN over the TBN of the reference lubricant. The TBN of each of the resulting samples was determined in accordance with each of ASTM D4739 and ASTM D2896 (in units of mg KOH/g). An additional amount of base oil was added to each of the samples to provide comparable total mass. The amounts of the reference lubricant and added compounds for each of the Inventive and Comparative Examples are shown in Table 1 below:

TABLE 1

Formulations of Inventive and Comparative Examples

| | Reference Lubricant | Inventive #1 | Inventive #2 | Comparative #1 | Comparative #2 | Comparative #3 |
|---|---|---|---|---|---|---|
| Reference Lubricant (g) | 94.00 | 94.00 | 94.00 | 94.00 | 94.00 | 94.00 |
| Additional Base Oil (g) | 6 | 4.87 | 4.17 | 4.76 | 5.06 | 4.88 |
| Tinuvin 292 (g) | — | 1.13 | — | — | — | — |
| 1,2,2,6,6-pentamethylpiper idyl-4-dodecanoate (g) | — | — | 1.83 | — | — | — |
| 1-dodecylamine (g) | — | — | — | 1.24 | — | — |
| N-N-dimethylcyclohexylamine (g) | — | — | — | — | 0.94 | — |
| 4-benzylpiperidine (g) | — | — | — | — | — | 1.12 |
| Total Weight (g) | 100.00 | 100.00 | 100.00 | 100.00 | 100.00 | 100.00 |
| Additional TBN | — | 3 | 3 | 3 | 3 | 3 |

The seal compatibility of the Inventive and Comparative examples was evaluated using an industry-standard CEC L-39-T96 seal compatibility test. The CEC-L-39-T96 seal compatibility test is performed by submitting the seal or gaskets in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. Each formulation was tested twice (Run #1 and Run #2) under the same conditions. The results of the seal compatibility test are shown below in Tables 2 and 3.

TABLE 2

| Seal Compatibility Test Results (Run 1) | | | | | | |
|---|---|---|---|---|---|---|
| | Reference Lubricant | Inventive #1 | Inventive #2 | Comparative #1 | Comparative #2 | Comparative #3 |
| Volume Change (%) | 0.5 | 1 | 0.9 | 15.7 | 0 | 3 |
| Points Hardness DIDC | 0 | 3 | 1 | 0 | 6 | 3 |
| Tensile Strength (%) | −3 | −51 | −25 | −64 | −75 | −70 |
| Elongation at Rupture (%) | −15 | −72 | −53 | −100 | −82 | −75 |

TABLE 3

| Seal Compatibility Test Results (Run 2) | | | | | | |
|---|---|---|---|---|---|---|
| | Reference Lubricant | Inventive #1 | Inventive #2 | Comparative #1 | Comparative #2 | Comparative #3 |
| Volume change (%) | 0.5 | 1.1 | 1.2 | 15.4 | −0.1 | 2.9 |
| Points Hardness DIDC | 0 | 4 | 1 | −1 | 0.6 | 3 |
| Tensile Strength (%) | −6 | −49 | −21 | −70 | −75 | −69 |
| Elongation at Rupture (%) | −10 | −74 | −50 | −98 | −78 | −76 |

As shown, Inventive Examples #1 and #2 exhibited improved seal compatibility performance, especially in terms of tensile strength, when compared to Comparative Examples #1-#3. Inventive Example #2 also showed an improvement in elongation at rupture, when compared to Comparative Examples #1-#3.

More particularly, the tensile strength of Inventive Example #1 was −51% and −49% and the tensile strength of Inventive Example #2 was −25% and −21% whereas the tensile strength of Comparative Examples #1, 2, 3, was −64 and −70; −75 and −75, and −70 and −69, respectively. Similarly, the elongation at rupture for Inventive Example #1 was −72 and −74% and the elongation at rupture for Inventive Example #2 was −53% and −50%, whereas the elongation at rupture of Comparative Examples #1, 2, 3, was −100 and −98; −82 and −78, and −75 and −76, respectively.

This testing shows that the compositions of Comparative Examples #1-3 degraded the tensile strength and elongation at rupture of the fluoroelastomer seal to a much greater degree than the composition of Inventive Example #1 and Inventive Example #2.

The TBN of each of the amine compounds (Inventive and Comparative) was determined in accordance with each of ASTM D4739 (in units of mg KOH/g). The results are shown in Table 4 below.

TABLE 4

| TBN of Neat Amine Compounds | | | | | |
|---|---|---|---|---|---|
| | Inventive #1 | Inventive #2 | Comparative #1 | Comparative #2 | Comparative #3 |
| TBN (mg KOH/g) by ASTM D4739 | 200 | 156 | 295 | 367 | 312 |

As shown in Tables 2-4, although Inventive Examples #1 and #2 demonstrated a lower TBN value relative the TBN values of the Comparative Examples #1-3, the seal compatibility of the Inventive Examples #1 and #2 was much improved in terms of tensile strength, and in terms of elongation at rupture for Inventive Example #2.

It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

What is claimed is:

1. A method of lubricating a system comprising a fluoropolymer seal with a lubricant composition, which comprises a base oil and a cyclic amine compound, said method comprising:

contacting the fluoropolymer seal with the cyclic amine compound of the lubricant composition, where the cyclic amine compound has a formula (I):

(I)

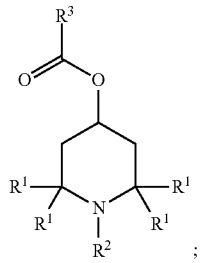

;

where each $R^1$ is independently selected from hydrogen, and an alkyl group, an alcohol group, an amide group, an ether group, and an ester group, each having from 1 to 17 carbon atoms, with at least one of $R^1$ being an independently selected alkyl group in formula (I);

where $R^2$ is an amide group having from 1 to 17 carbon atoms; and where $R^3$ is an alkyl group having from 7 to 17 carbon atoms.

2. A method according to claim 1 where each $R^1$ is an independently selected alkyl group having from 1 to 6 carbon atoms in formula (I), and where $R^3$ is an alkyl group having from 7 to 14 carbon atoms.

3. A method according to claim 2 where the cyclic amine compound is present in an amount ranging from 0.1 to 10 wt. %, based on a total weight of the lubricant composition.

4. A method according to claim 3 where the lubricant composition further comprises a dispersant, an anti-wear additive comprising sulfur and/or phosphorus, or combinations thereof.

5. A method according to claim 4 where the base oil is selected from an API Group I Oil, an API Group II Oil, an API Group III Oil, an API Group IV Oil, and combinations thereof, and where the base oil has a viscosity ranging from 1 to 20 cSt when tested at 100° C. according to ASTM D445.

6. A method according to claim 5 where the cyclic amine compound has a weight average molecular weight ranging from 100 to 1200.

7. A method according to claim 5 where the cyclic amine compound has a total base number value of at least 70 mg KOH per g of the cyclic amine compound when tested according to ASTM D4739.

8. A method according to claim 5 where the system comprises an internal combustion engine.

9. A method according to claim 1 where the cyclic amine compound comprises only one ester group.

10. A method according to claim 1 where the lubricant composition comprises less than 0.1 wt. % of compounds which would react with the cyclic amine compound based on the total weight of the lubricant composition.

11. A method of improving fluoropolymer seal compatibility performance of a lubricant composition, said method comprising:

combining a base oil and a cyclic amine compound to form the lubricant composition, where the cyclic amine compound has a formula (I):

(I)

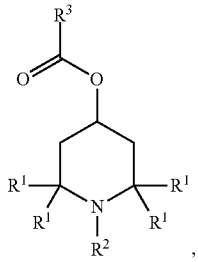

, where each $R^1$ is independently selected from hydrogen, an alkyl group, an alcohol group, an amide group, an ether group, and an ester group, each having from 1 to 17 carbon atoms, with at least one of $R^1$ being an independently selected alkyl group, where $R^2$ is an amide group having from 1 to 17 carbon atoms; and where $R^3$ is an alkyl group having from 7 to 17 carbon atoms.

12. A method according to claim 11 where each $R^1$ is an independently selected alkyl group having from 1 to 6 carbon atoms in formula (I), and where $R^3$ is an alkyl group having from 7 to 14 carbon atoms.

13. A method according to claim 12 where the cyclic amine compound is present in an amount ranging from 0.1 to 10 wt. %, based on a total weight of the lubricant composition.

14. A method according to claim 13 where the lubricant composition further comprises a dispersant, an anti-wear additive comprising sulfur and/or phosphorus, or combinations thereof.

15. A method according to claim 14 where the base oil is selected from an API Group I Oil, an API Group II Oil, an API Group III Oil, an API Group IV Oil, and combinations thereof, and where the base oil has a viscosity ranging from 1 to 20 cSt when tested at 100° C. according to ASTM D445.

16. A method according to claim 15 where the cyclic amine compound has a weight average molecular weight ranging from 100 to 1200.

17. A method according to claim 15 where the cyclic amine compound has a total base number value of at least 70 mg KOH per g of the cyclic amine compound when tested according to ASTM D4739.

18. A method according to claim 15 where the fluoropolymer seal compatibility performance comprises a change in tensile strength of the fluoropolymer seal.

19. A method according to claim 11 where the cyclic amine compound comprises only one ester group.

20. A method according to claim 11 where the lubricant composition comprises less than 0.1 wt. % of compounds which would react with the cyclic amine compound based on the total weight of the lubricant composition.

* * * * *